US008539681B2

(12) United States Patent
Stein et al.

(10) Patent No.: US 8,539,681 B2
(45) Date of Patent: Sep. 24, 2013

(54) MANUALLY GUIDED IMPLEMENT

(75) Inventors: Gunter Stein, Winnenden (DE); Eberhard Bohnaker, Leutenbach (DE); Wolfgang Weissert, Winnenden (DE); Johannes Menzel, Wernau (DE)

(73) Assignee: Andreas Stihl AG & Co., KG (DE)

( * ) Notice: Subject to any disclaimer, the term of this patent is extended or adjusted under 35 U.S.C. 154(b) by 1557 days.

(21) Appl. No.: 11/497,106

(22) Filed: Aug. 1, 2006

(65) Prior Publication Data

US 2007/0028464 A1 Feb. 8, 2007

(30) Foreign Application Priority Data

Aug. 5, 2005 (DE) ..... 10 2005 036 885

(51) Int. Cl.
*B27B 17/00* (2006.01)

(52) U.S. Cl.
USPC ..... 30/381; 30/382

(58) Field of Classification Search
USPC ..... 30/381–387; 83/830–834
See application file for complete search history.

(56) References Cited

U.S. PATENT DOCUMENTS

| | | | | | |
|---|---|---|---|---|---|
| 3,542,095 | A * | 11/1970 | Hammond et al. | ..... | 30/381 |
| 3,845,557 | A * | 11/1974 | Bailey | ..... | 30/381 |
| 3,934,344 | A * | 1/1976 | Inaga | ..... | 30/381 |
| 4,694,578 | A * | 9/1987 | Kemmler | ..... | 30/383 |
| 5,029,393 | A * | 7/1991 | Nagashima et al. | ..... | 30/383 |
| 5,046,566 | A * | 9/1991 | Dorner et al. | ..... | 173/162.2 |
| 6,427,641 | B1 * | 8/2002 | Ziegs | ..... | 123/41.56 |
| 6,799,373 | B2 * | 10/2004 | Menzel et al. | ..... | 30/381 |
| 6,994,068 | B2 * | 2/2006 | Menzel et al. | ..... | 123/192.1 |

* cited by examiner

*Primary Examiner* — Phong Nguyen
(74) *Attorney, Agent, or Firm* — Robert W. Becker; Becker & Stachniak, P.C.

(57) ABSTRACT

A manually guided implement having an engine housing and a handle housing that are interconnected by anti-vibration elements. The handle housing is provided with a longitudinal support having, relative to a conventional operating position of the implement, a front end face that is disposed transverse to a longitudinal axis of the longitudinal support. A securement end of a front tubular handle rests against and is secured to the front end face of the longitudinal support.

10 Claims, 5 Drawing Sheets

MANUALLY GUIDED IMPLEMENT

The instant application should be granted the priority date of Aug. 5, 2005 the filing date of the corresponding German patent application 10 2005 036 885.9.

BACKGROUND OF THE INVENTION

The present invention relates to a manually guided implement, such as a chain saw, a trimmer or the like.

Manually guided implements such as chain saws, trimmers or the like are held and guided by the user with handles during operation. For example, with regard to a chain saw, relative to a conventional operating position, a rear handle that faces the user and a front tubular handle that faces the saw chain are provided for carrying, supporting and guiding.

During operation, the drive motor and the cutting tool generate vibrations that should be kept away from the handles. For this purpose, a dual-part construction having an engine housing and a separate handle housing is provided, whereby the handle housing and the engine housing are interconnected by anti-vibration elements. The rear handle and the front tubular handle are secured to the handle housing and are isolated from the engine housing with respect to vibrations by means of the anti-vibration elements.

For an ergonomic holding of the handle in different grip positions, the front tubular handle is guided about the engine housing in a curved manner, and is secured to a lower longitudinal support of the handle housing via a lower securement end. With regard to the overall size of the engine housing, the longitudinal support has a low overall height. The tubular handle is also flattened in the region of the connection end, and is screw-connected from below with the longitudinal support of the handle housing. The little overall height of the longitudinal support that is available permits only slight screw-in depths. The flattening of the tubular handle at the securement end is complicated and requires an additional operation during manufacture.

It is therefore an object of the present invention to improve a manually guided implement of the aforementioned general type such that the securement in the region of the end of the tubular handle is simplified taking into account the spatial limitations caused by the engine housing.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
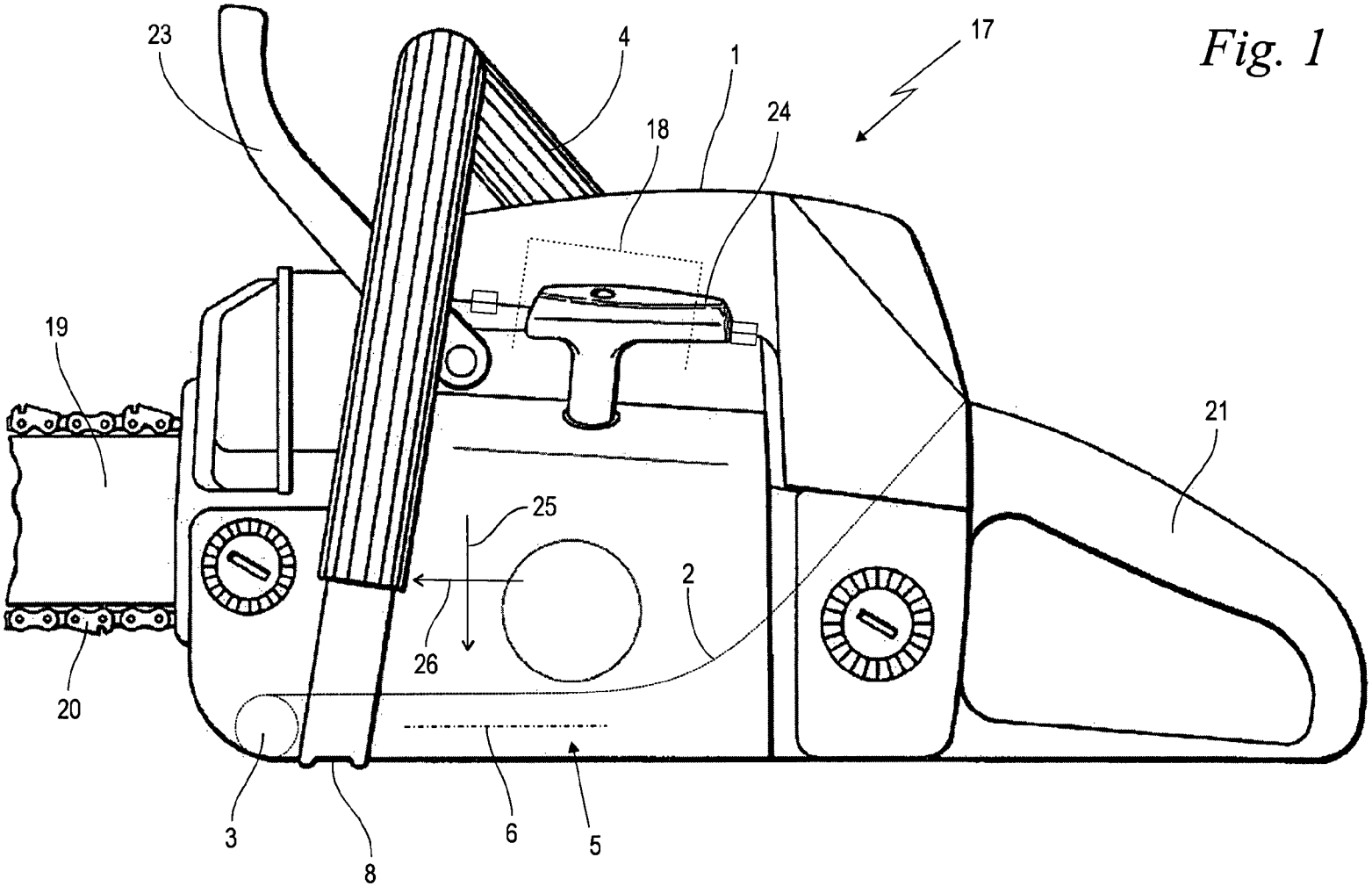
FIG. 1 is a side view of a portion of a manually guided implement, by way of example a power chain saw, having a tubular handle secured to the handle housing.

Pursuant to the manually guided implement of the present application, the handle housing is provided with a longitudinal support having, relative to a conventional operating position of the implement, a front end face that is disposed transverse to a longitudinal axis of the longitudinal support, wherein a securement end of the front tubular handle rests against and is secured to the front end face of the longitudinal support. In particular, the securement end of the tubular handle is screw-connected to the front end face, whereby at least one securement screw of the securement end is disposed at least approximately in the direction of the longitudinal axis of the longitudinal support.

Pursuant to a preferred arrangement of the end face relative to a perpendicular to the longitudinal axis in an angle range of from 0 to 45°, and in particular from 0 to 20°, and of the inventive securement at the end face, the heights of the tubular handle and of the longitudinal support are not additive. The securement end of the tubular handle can be embodied such that there is no additional overall size and without having to have a flattened portion. One or more securement screws that are disposed at least approximately in the longitudinal direction can have an adequate length and with a correspondingly great screw-in depth can be threaded into axially parallel screw holes, without hereby having to take into consideration limitations resulting from the overall height that is available.

The cross-sectional height of the longitudinal support expediently corresponds at least approximately to a cross-sectional height of the securement end of the tubular handle. In particular, the tubular handle, at least in a grip region thereof, has a circular cross-section having a grip diameter, whereby the cross-sectional height of the securement end corresponds to the grip diameter. The carrying ability of the tubular handle, which is dictated by its shape, is provided over its entire extent, including the securement end. With a nearly uniform structural height of the securement end and of the longitudinal support, the full rigidity is ensured with a minimal overall height. The handle housing and the tubular handle form a unit that is isolated from the engine housing with regard to vibration, and which is at least approximately rigid. Acceleration amplitudes that are caused by vibration can be reduced.

Pursuant to a preferred further development, the securement end of the tubular handle is positively held between the end face of the longitudinal support and a clamping element. In particular, the clamping element is embodied as a clamping shell that at least nearly entirely surrounds the securement end. The position of the securement end is precisely fixed. Force peaks are avoided in the region of the securement.

Pursuant to an expedient embodiment, a securement sleeve is provided for receiving the securement screw, whereby the securement end of the tubular handle has a receiving bore that surrounds the securement sleeve in a manner that is at least nearly free of play. In the installed state, the securement screw is held in the securement sleeve with a high carrying capacity. In comparison to the securement screw, the securement sleeve has a larger diameter, via which it is disposed in the receiving bore of the securement end. Only slight surface pressures occur, thus contributing to the increase of the rigidity without an increase of the cross-section.

The securement sleeve can be part of the end face and is expediently disposed on the clamping element, in particular being monolithically formed with the clamping element. During installation, the clamping element can easily be inserted or placed upon the securement end of the tubular handle, whereby the securement sleeve or sleeves are inserted into the receiving bores. The clamping element is positively fixed relative to the securement end of the tubular handle. Assembly is simplified.

Pursuant to a preferred embodiment, the clamping element has a point of attachment for the anti-vibration element. The point of attachment is assembled together with the clamping element, whereby in the installed state the securement end is disposed between the point of attachment and the longitudinal support of the handle housing. A slim, space-saving construction results.

The aforementioned preferred embodiments are suitable for tubular handles of metal, especially of aluminum. The maximum cross-sectional utilization in particular also permits a very rigid securement of a tubular handle made of polymeric material.

Pursuant to a preferred embodiment, the securement end of the tubular handle, and in particular the entire tubular handle, is made of polymeric material, whereby a screw-receiving means for the securement screw can be formed into the securement end. With a high rigidity, the number of individual components, and hence the manufacturing and assembly expenditure, are reduced. A molded part for a positive securement of the position relative to the end face is expediently monolithically formed on the securement end of the tubular handle, with the end being formed of polymeric material. In addition to securing the position, the molded part can also absorb operating forces and provide relief for the securement screws.

A point of attachment for the anti-vibration element is advantageously monolithically formed on the securement end of the tubular handle, which end is again formed of polymeric material. While avoiding connection locations, a high rigidity with low overall height results.

Further specific features of the present application will be described in detail subsequently.

DESCRIPTION OF SPECIFIC EMBODIMENTS

Referring now to the drawings in detail, FIG. 1 shows a manually-guided or portable implement 17, by way of example a chain saw that is driven by a non-illustrated internal combustion engine 18. A hedge trimmer or the like could also be provided. In place of the internal combustion engine 18, an electric motor could also be provided as the drive motor. The internal combustion engine 18 is supported in an engine housing 1 and drives a saw chain 20, which is rotatingly guided about a partially illustrated guide bar 19.

In a conventional operating position of the implement 17, there is established a forward direction, which faces forward from the user and is indicated by the arrow 26; the guide bar 19 with the saw chain 20 is disposed in the forward direction 26 ahead of the engine housing 1. Provided on a handle housing 2, which is separate from the engine housing 1, and relative to the forward direction 26, is a rear handle 21 that is disposed at the rear of the engine housing 1, while secured to the front region of the handle housing 2 is a front tubular handle 4 that extends around the engine housing 1.

The engine housing 1 extends approximately in a U-shaped manner, and with play, about a longitudinal member or support 5 of the handle housing 2 that is merely indicated in FIG. 1; a longitudinal axis 6 of the longitudinal support 5 extends approximately in the forward direction 26. Relative to the illustrated conventional operating position, a downwardly directed weight direction is illustrated by the arrow 25. Relative to the arrows 25, 26, the longitudinal support 5 extends centrally downwardly through the engine housing 1.

The handle housing 2 and the engine housing 1 are interconnected via a number of anti-vibration elements 3, whereby in order to facilitate illustration only one anti-vibration element 3 is illustrated by way of example. The illustrated anti-vibration element 3 is disposed ahead of a securement end 8 of the tubular handle 4 between a longitudinal support 5 and the engine housing 1. By means of the anti-vibration elements 3, the handle housing 2, along with the rear handle 21 that is formed thereon and the tubular handle 4 that is secured thereto, is isolated from the engine housing 1 with regard to vibrations.

Disposed between the front tubular handle 4 and the guide bar 19 is a lever 23 of a brake device for the saw chain; the lever 23 is pivotably mounted on the engine housing 1 and if necessary can be actuated by that hand of the operator that grasps the front tubular handle 4. A rope pull starter 24 is provided for starting the internal combustion engine 18.

Figure 2:
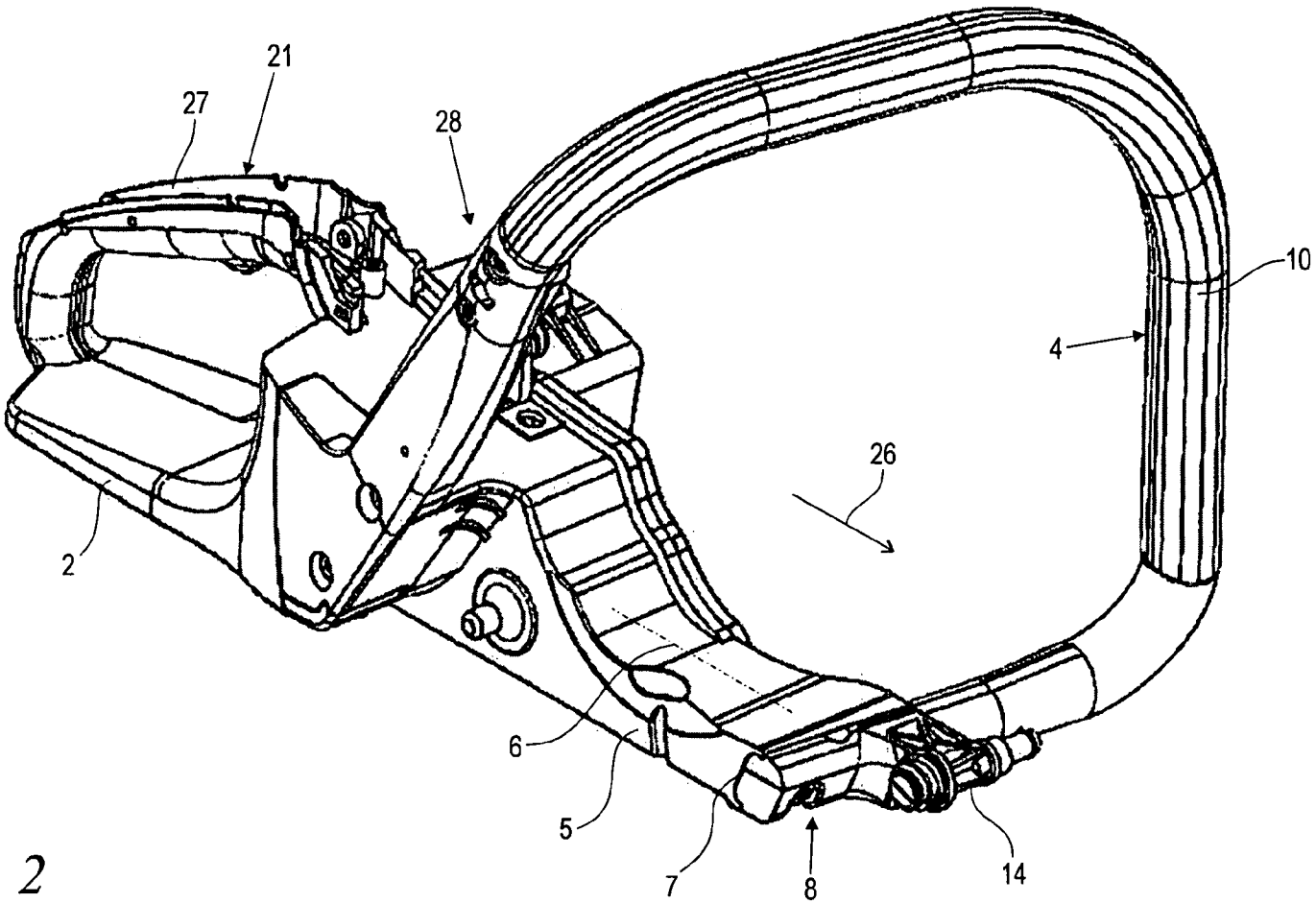
FIG. 2 is a perspective illustration of the handle housing of FIG. 1, with a tubular handle screw-connected to an end face of the longitudinal support of the handle housing.

FIG. 2 shows a perspective view of the handle housing 2 of FIG. 1. The handle housing 2 is embodied as an injection molded plastic part on which is monolithically formed a housing section 27 to form the rear handle 21. The tubular handle 4 includes a central grip region 10 that extends in an arched manner and that is surrounded by a slip-retarding plastic sleeve. Disposed at each end of the grip region 10 is a respective securement end 8, 28 by means of which the tubular handle 4 is screw-connected or otherwise secured to the handle housing 2.

The longitudinal support 5 ends at the securement end 8 of the tubular handle 4. The securement end 8 is secured to the forward end of the longitudinal support 5. Relative to the forward direction 26, the longitudinal support 5 of the handle housing 2 is provided with an end face 7 that is disposed transverse to the longitudinal axis 6 and is inclined slightly downwardly. In the illustrated embodiment, the end face 7 is inclined downwardly by approximately 20° relative to a line perpendicular to the longitudinal axis 6. To achieve an adequate screw-in depth of securement screws 9 (FIGS. 3-5), an angle range of from 0 to 45° relative to a line perpendicular to the longitudinal axis 6 is expedient. An end surface of the front, lower securement end 8 of the grip region 10 rests against the end face 7 and is screw-connected therewith. Instead of a screw connection, some other, in particular positive or form-interlocking, securement can also be provided.

Figure 3:
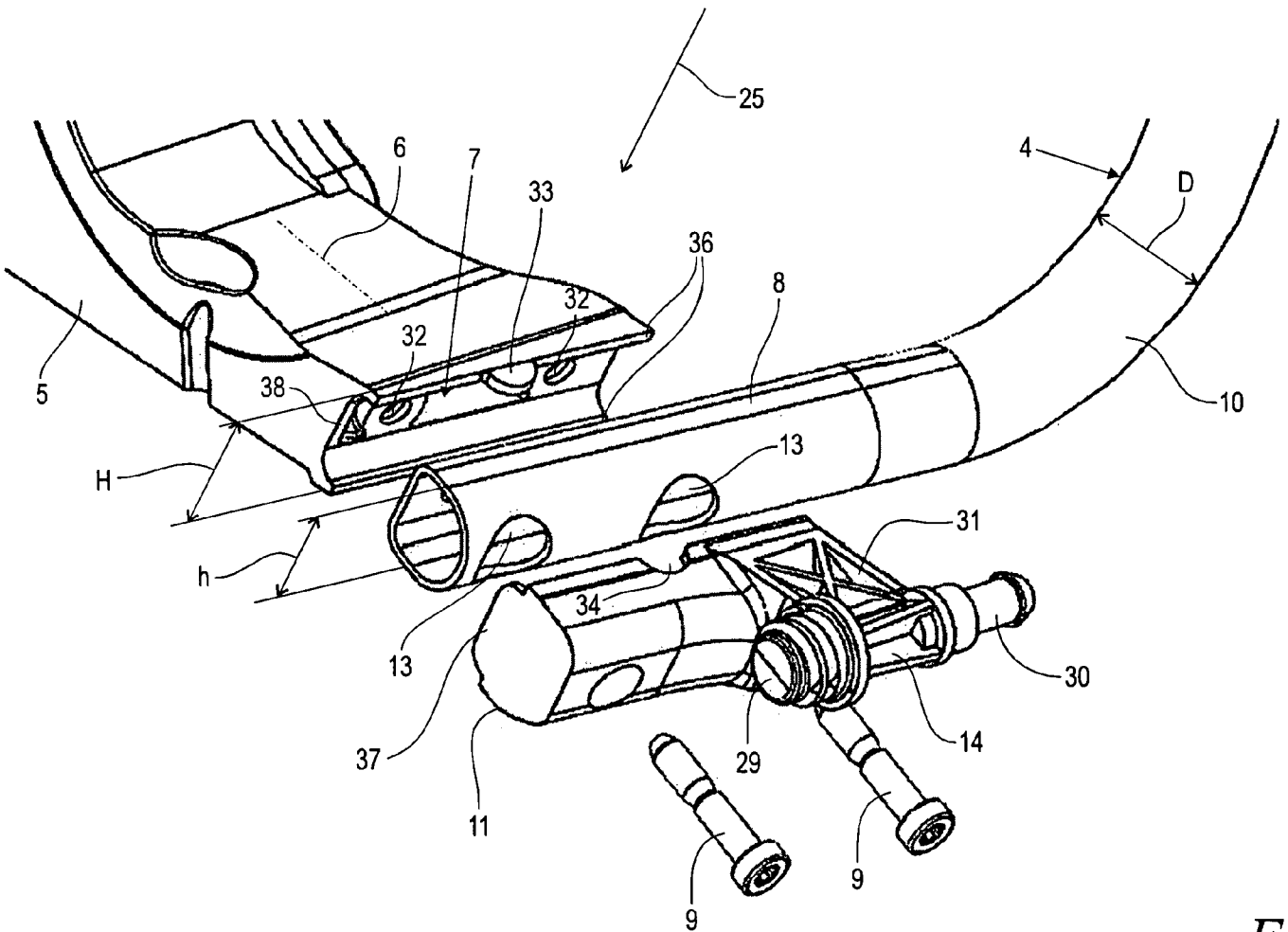
FIG. 3 is an enlarged, exploded detailed view of a first embodiment of the arrangement of FIG. 2 showing the screw connection to the end face via a clamping element.

Also provided at the securement end 8 of the tubular handle 4 is a point of attachment 14 for the anti-vibration element 3 that is shown in FIG. 1; in line with the longitudinal axis 6, the point of attachment 14 extends beyond the securement end 8, which is thus disposed between the point of attachment 14 and the longitudinal support 5 (see FIG. 3). By tightly connecting the securement end 8 with the end face 7 of the longitudinal support 5, in the assembled state the securement end 8, together with the point of attachment 14, become part of the longitudinal support 5, the front end of which is then formed by the point of attachment 14.

FIG. 3 shows a first embodiment of the arrangement of FIG. 2 in an enlarged exploded illustration of the region of the end face 7. By way of example, the tubular handle 4 can be an aluminum tube which in the grip region 10 has a circular cross-section having a diameter D, and which in the region of its securement end 8 is formed into a D-shaped cross-section. Relative to the weight and vertical direction in the conventional operating position indicated by the arrow 25, the securement end 8 has a cross-sectional height h that is essentially identical to the diameter D of the grip region 10. A cross-sectional height H of the longitudinal support 5 in the region of the end face 7 is only slightly greater than the cross-sectional height h of the securement end 8, so that in the installed state, flat transverse edges 36 that embrace the end face 7, as well as a nose 33 formed on the transverse edges, extend about the top and bottom of the securement end 8.

To secure the securement end 8 to the end face 7, a clamping element 11 and two securement screws 9 are provided. The two securement screws 9 are disposed perpendicular to the plane of the end face 7 and are thus disposed approximately parallel to the longitudinal axis 6 of the longitudinal support 5. The securement screws 9 are provided for being threaded into the screw holes 32 of the end face 7. In the preferred angle range of the inclined position of the end face 7, the at least approximately parallel arrangement of the securement screws 9, with regard to the longitudinal axis 6, leads to great screw-in depths, even with a low overall height of the longitudinal support 5. In the installed and screw-connected state, the securement end 8 is positively held between the end face 7 and the clamping element 11. The clamping element 11 can be a clamp, bracket or the like, and in the illustrated embodiment is in the form of a clamping shell that at least nearly entirely surrounds the securement end 8. In this connection, an end wall of the clamping shell closes off the end opening of the tubular handle 4 at the securement end 8.

In the installed state, to secure the position the nose 33 extends into a correspondingly formed recess 34 of the clamping element 11, while a projection or tab 37 formed on the lateral end face of the clamping element 11 engages into a corresponding lateral recess 38 that is disposed between the transverse edges 36 of the longitudinal support 5. In order to be able to screw-connect the securement end 8 with the end face 7 of the longitudinal support 5, two receiving bores 13 extend in the direction of the longitudinal axis 6 through the securement end 8, and make it possible to guide the securement screws 9 through and into the screw holes 32. Further details of the receiving bores 13 are described in greater detail in conjunction with FIG. 4.

The point of attachment 14 is monolithically formed on the clamping element 11, which is produced of injection molded polymeric material, whereby an arm 31, which extends in the direction of the longitudinal axis 6, is provided on one side with a threaded pin 29 and on the opposite side with a smooth pin 30. The arrangement shown here is illustrated by way of example for an embodiment of the anti-vibration element 3 (FIG. 1) that is composed of a helical spring and a dampening element of polymeric material. The helical spring is screwed onto the threaded pin 29, while the dampening element is placed onto the smooth pin 30.

Figure 4:
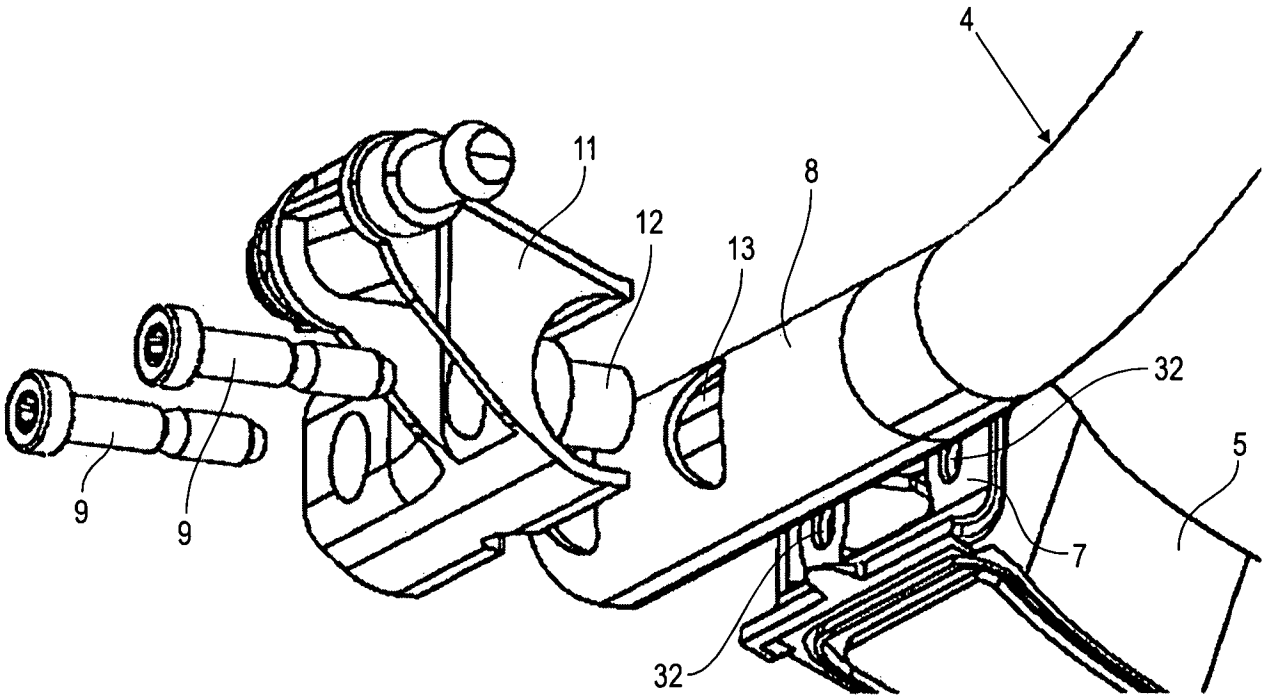
FIG. 4 is an enlarged perspective bottom view of the arrangement of FIG. 3 showing further details of the clamping element with formed-on securement sleeves.

FIG. 4 shows an enlarged, perspective bottom view of the arrangement of FIG. 3 in a region of the securement end 8. It can be seen that monolithically formed on the clamping element 11 are two cylindrical securement sleeves 12, the diameters of which are stepped, and which are provided for receiving the securement screws 9. In the installed state, the heads of the securement screws 9 are disposed in the larger diameter region of the securement sleeves 12, while the shafts of the securement screws 9 are guided through the portion of the securement sleeves 12 having the smaller diameter. The two receiving bores 13, which extend all the way through, are provided on that side that faces the clamping element 11 with a greater diameter than on that side that faces the end face 7, with the diameters being coordinated with the securement sleeve 12 in such a way that in the installed state the receiving bores 13 surround the respective stepped securement sleeves 12 in a manner free of play. Thus, the securement sleeves 12 are guided entirely through the cross-section of the securement end 8, and in the screw-connected state rest against the end face 7 of the longitudinal support 5. The securement screws 9 are not in direct contact with the securement ends 8. Rather, the securement end 8 is positively held on the respective securement sleeves 12 by means of the receiving bores 13, as well as being positively clamped between the clamping element 11 and the end face 7. The clamping is effected by threading the securement screws 9 into the screw holes 32, whereby the clamping element 11 is clamped in the axial direction against the end face 7, thereby clamping in the securement end 8.

For the fixation of the receiving bores 13, the securement sleeves 12 can be embodied as loose individual components, or can be monolithic with the end face 7; in the illustrated embodiment, the securement sleeves 12 are monolithically formed with the clamping element 11.

Figure 5:
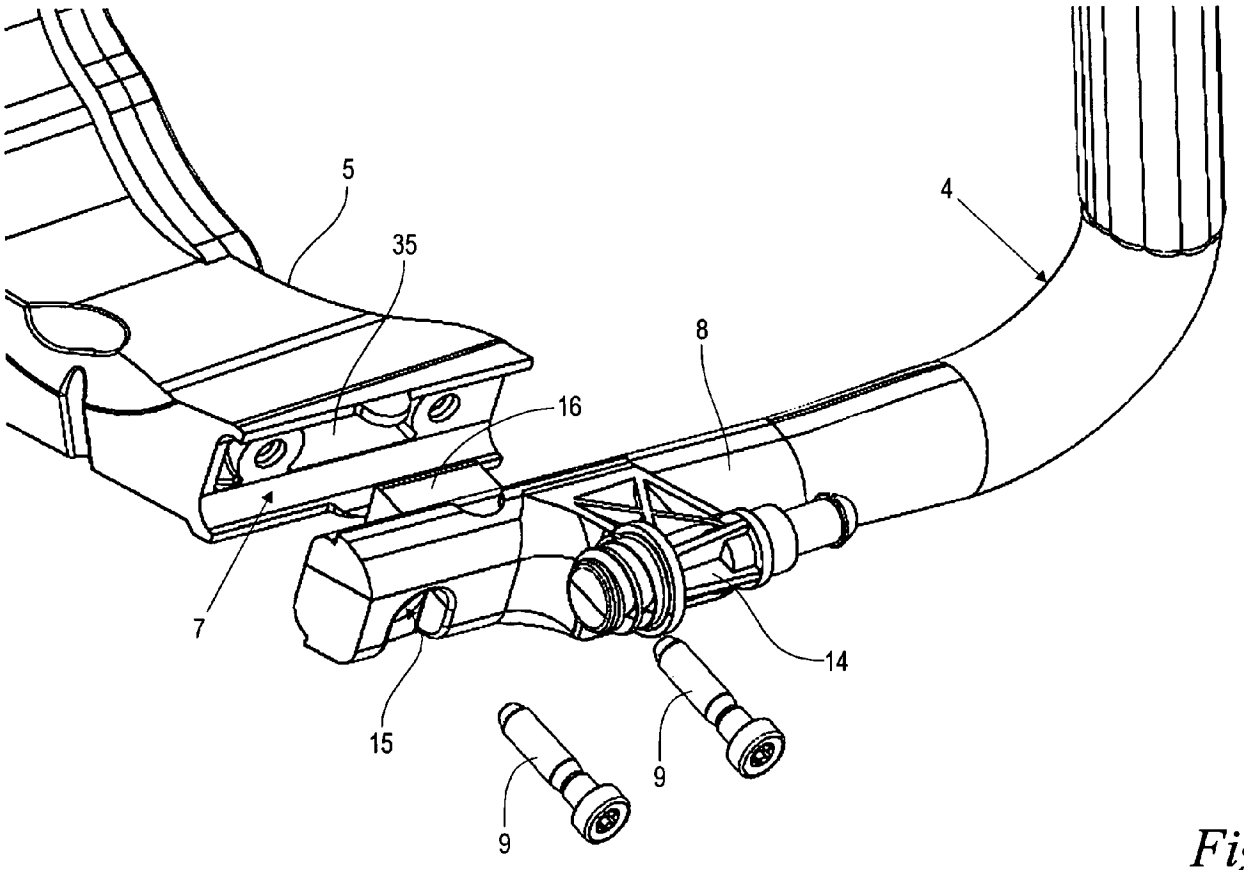
FIG. 5 is a further embodiment as a variation of the arrangement of FIG. 3, including a securement end of the tubular handle that is monolithically formed of polymeric material.

FIG. 5 shows a second embodiment as a variation of the arrangement of FIGS. 3 and 4, according to which the tubular handle 4, as one piece or monolithically with the securement end 8, is made entirely of polymeric material, whereby the point of attachment 14 for the anti-vibration element 3 is monolithically formed on the securement end 8. Formed into the securement end 8 are two screw-receiving means 15 for guiding the securement screws 9 through. Furthermore, an approximately paralielepipedal molded part 16 is formed on that side that faces the end face 7; in the installed state, the molded part 16 extends into a correspondingly formed opening 35 of the end face 7 to ensure proper positioning.

In place of a monolithic configuration of the securement end 8 with the tubular handle 4, a separate configuration can also be expedient, whereby a securement end 8 that is formed of polymeric material can also be connected with a tubular handle 4 of metal. The remaining features and reference numerals of the arrangement of FIG. 5 correspond with those of FIGS. 3 and 4.

The specification incorporates by reference the disclosure of German priority document DE 10 2005 036 885.9 filed 5 Aug. 2005.

The present invention is, of course, in no way restricted to the specific disclosure of the specification and drawings, but also encompasses any modifications within the scope of the appended claims.

What we claim is:

1. A manually guided implement, comprising:

an engine housing;

a handle housing, wherein said engine housing and said handle housing are interconnected by means of anti-vibration means, wherein said handle housing is provided with a longitudinal support having, relative to a conventional operating position of said implement, a front end face that is disposed transverse to a longitudinal axis of said longitudinal support, and wherein said front end face is disposed at an angle of from 0 to 20° relative to a line perpendicular to said longitudinal axis;

a front tubular handle having a securement end that rests against and is secured to said front end face of said longitudinal support; and a clamping element, wherein said securement end of said tubular handle is positively held between said front end face of said longitudinal support and said clamping element, wherein said clamping element is in the form of a clamping shell that surrounds said securement end of said tubular handle, wherein at least one securement screw is provided for effecting a screw connection of said securement end of said tubular handle to said front end face of said longitudinal support, wherein said at least one securement screw is disposed perpendicular to a plane of said front end face and hence is disposed at least approximately in the direction of said longitudinal axis of said longitudinal support, and wherein said clamping element is provided with a point of attachment for said anti-vibration means.

2. An implement according to claim 1, wherein said longitudinal support has a cross-sectional height (H) that corresponds at least approximately to a cross-sectional height (h) of said securement end of said tubular handle.

3. An implement according to claim 1, wherein at least a grip region of said tubular handle has a circular cross-section having a grip diameter (D), and wherein a cross-sectional height (h) of said securement end (8) of said tubular handle corresponds to said grip diameter (D) thereof.

4. An implement according to claim 1, wherein said clamping shell at least nearly entirely surrounds said securement end of said tubular handle.

5. An implement according to claim 1, wherein a securement sleeve is provided for receiving a securement screw, and wherein said securement end of said tubular handle has a receiving bore that surrounds said securement sleeve in a manner that is at least approximately free of play.

6. An implement according to claim 5, wherein said securement sleeve is disposed on a clamping element.

7. An implement according to claim 6, wherein said securement sleeve is monolithically formed with said clamping element.

8. A manually guided implement comprising:

an engine housing;

a handle housing, wherein said engine housing and said handle housing are interconnected by means of anti-vibration means, wherein said handle housing is provided with a longitudinal support having, relative to a conventional operating position of said implement, a front end face that is disposed transverse to a longitudinal axis of said longitudinal support, and wherein said front end face is disposed at an angle of from 0 to 20° relative to a line perpendicular to said longitudinal axis;

a front tubular handle having a securement end that rests against and is secured to said front end face of said longitudinal support; and at least one securement screw for effecting a screw connection of said securement end of said tubular handle to said front end face of said longitudinal support, wherein said at least one securement screw is disposed at least approximately perpendicular to a plane of said front end face and also in the direction of said longitudinal axis of said longitudinal support, wherein said securement end of said tubular handle is formed of polymeric material, wherein a screw-receiving means is formed in said securement end for said securement screw; and wherein a point of connection for said anti-vibration means is monolithically formed on said securement end of said tubular handle.

9. An implement according to claim 8, wherein the entire tubular handle is made of polymeric material.

10. An implement according to claim 8, wherein a molded part for positively securing a position of said securement end of said tubular handle relative to said front end face of said longitudinal support is monolithically formed on said securement end.

* * * * *